US007134489B2

(12) United States Patent
Van Riet

(10) Patent No.: US 7,134,489 B2
(45) Date of Patent: Nov. 14, 2006

(54) SYSTEM FOR CONTROLLING THE DISCHARGE OF DRILLING FLUID

(75) Inventor: Egbert Jan Van Riet, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/489,595

(22) PCT Filed: Sep. 13, 2002

(86) PCT No.: PCT/EP02/10366

§ 371 (c)(1),
(2), (4) Date: Jun. 25, 2004

(87) PCT Pub. No.: WO03/025334

PCT Pub. Date: Mar. 27, 2003

(65) Prior Publication Data

US 2004/0231889 A1 Nov. 25, 2004

(30) Foreign Application Priority Data

Sep. 14, 2001 (EP) ..... 01307865

(51) Int. Cl.
*E21B 21/01* (2006.01)
*F04B 9/08* (2006.01)
*F04B 43/073* (2006.01)

(52) U.S. Cl. ..... 166/207; 417/383; 417/395

(58) Field of Classification Search ..... 166/207, 166/217, 218; 175/217, 207, 218, 57; 417/225, 417/383, 389, 394, 395
See application file for complete search history.

(56) References Cited

U.S. PATENT DOCUMENTS

| | | | | |
|---|---|---|---|---|
| 4,406,595 | A * | 9/1983 | Robertson et al. | 417/383 |
| 4,460,318 | A * | 7/1984 | Horton | 417/54 |
| 4,611,578 | A * | 9/1986 | Heimes | 600/19 |
| 4,755,111 | A * | 7/1988 | Cocchi et al. | 417/394 |
| 5,806,612 | A | 9/1998 | Vorhoff et al. | 175/40 |
| 5,890,549 | A | 4/1999 | Sprehe | |
| 6,033,192 | A | 3/2000 | Wood | |
| 6,102,673 | A | 8/2000 | Mott et al. | |

FOREIGN PATENT DOCUMENTS

| | | |
|---|---|---|
| WO | 00/79092 | 12/2000 |
| WO | 01/20120 | 3/2001 |

OTHER PUBLICATIONS

International Search Reported dated Dec. 18, 2002.

* cited by examiner

*Primary Examiner*—Kenneth Thompson

(57) ABSTRACT

A drilling system is provided for drilling a borehole into an earth formation, the drilling system comprising pump means for pumping drilling fluid into the borehole and discharge means for discharging drilling fluid from the borehole. The discharge means comprises at least one pressure chamber for temporarily accommodating drilling fluid being discharged from the borehole, and control means for controlling the fluid inflow into each pressure chamber.

19 Claims, 2 Drawing Sheets

SYSTEM FOR CONTROLLING THE DISCHARGE OF DRILLING FLUID

The present application claims priority on European Patent Application 01307865.4 filed on 14 Sep. 2001.

FIELD OF THE INVENTION

The present invention relates to a drilling system and a method for drilling a borehole into an earth formation, the drilling system comprising pump means for pumping drilling fluid into the borehole and discharge means for discharging drilling fluid from the borehole.

The drilling system may furthermore comprise a drill string extending into the borehole whereby an annular space is formed between the drill string and the borehole wall, the annular space containing a body of drilling fluid. The drill string generally has a longitudinal passage for pumping drilling fluid into the annular space through a opening near the lower end of the drill string. The drilling fluid can be discharged from the borehole through a discharge conduit connected with the borehole near the upper end of said annular space. The flow of drilling fluid through said annular space can be controlled by said discharge means, for example by a controllable resistance in said discharge conduit.

Therefore the discharge conduit can be provided with a choke valve providing a controllable throttle opening. However, because of rock debris and contaminated mud in the drilling fluid a throttle opening in the discharge conduit shall be worn out soon.

BACKGROUND OF THE INVENTION

WO-A-0079092 discloses such drilling system, whereby the discharge means control the discharge of drilling fluid, and therewith the flow of drilling fluid through the annular space. Therefore the discharge conduit is provided with a controllable outlet valve. As an alternative WO-A-0079092 describes an injection pump arranged to pump injection fluid via an injection nozzle into the discharge conduit in a direction opposite to the direction of flow of drilling fluid through the discharge conduit. By controlling the injection fluid, the resistance in the discharge conduit can be controlled.

SUMMARY OF THE INVENTION

In accordance with the invention there is provided a drilling system for drilling a borehole into an earth formation, the drilling system comprising pump means for pumping drilling fluid into the borehole and discharge means for discharging drilling fluid from the borehole, wherein the discharge means comprises at least one pressure chamber for temporarily accommodating drilling fluid being discharged from the borehole, and control means for controlling the fluid inflow into each pressure chamber.

Thereby it is achieved that the drilling fluid from the borehole is transported to the pressure chamber and the inflow of it into the pressure chamber can be controlled without a restriction through which the drilling fluid has to flow.

Preferably said control means is arranged to control the fluid pressure in the pressure chamber.

The inflow of drilling fluid into the pressure chamber can be controlled by controlling the outflow of gas or liquid which is expelled from the pressure chamber by the inflow of drilling fluid. Such gas or liquid, hereinafter referred to as expel fluid, can be led through a controllable throttle opening, thereby controlling the inflow of drilling fluid. In fact thereby the said control means control fluid pressure above the drilling fluid in the pressure chamber.

In fact the discharge of drilling fluid from the borehole is controlled by throttling the expel fluid in stead of throttling the drilling fluid. And because the expel fluid does not contain rock debris or contaminated mud, there is no wear problem in the choke valve throttling the fluid.

Preferably the pressure chamber is provided with two compartments separated by a flexible membrane, whereby one of the compartments is to be filled with drilling fluid and the other compartment contains an expel fluid, whereby said control means control the outflow of said expel fluid from the pressure chamber.

In a preferred embodiment two or more pressure chambers being alternately filled with drilling fluid from the borehole, whereby said control means control the inflow of drilling fluid in each of the pressure chambers. By making use of more than one pressure chamber, the drilling fluid can be removed from a pressure chamber while the drilling fluid from the borehole can be led to another pressure chamber.

Preferably two pressure chambers are interconnected by an expel fluid conduit for transporting an expel fluid between the two pressure chambers, whereby said control means comprise a control valve in said expel fluid conduit.

In a preferred embodiment the discharge means comprise two pressure chambers, each provided with a membrane to form a drilling fluid compartment and an expel fluid compartment, both having a variable content, the expel fluid compartments being interconnected by an expel fluid conduit provided with a control valve for controlling flow through said expel fluid conduit, the system furthermore being provided with inlet valve means to direct the drilling fluid to be discharged alternately to one of said drilling fluid compartments and with outlet valve means to remove drilling fluid from the other drilling fluid compartment.

The invention furthermore relate to a method for drilling a borehole into an earth formation, whereby drilling fluid is pumped into the borehole and whereby drilling fluid is discharged from the borehole and transported to a pressure chamber, whereby the inflow of drilling fluid into the pressure chamber is controlled.

BRIEF DESCRIPTION OF THE DRAWINGS

The invention will now be described in more detail and by way of example with reference to the accompanying drawing in which.

In the figures like reference numerals relate to like components.

DETAILED DESCRIPTION OF THE PREFERRED EMBODIMENT

Figure 1:
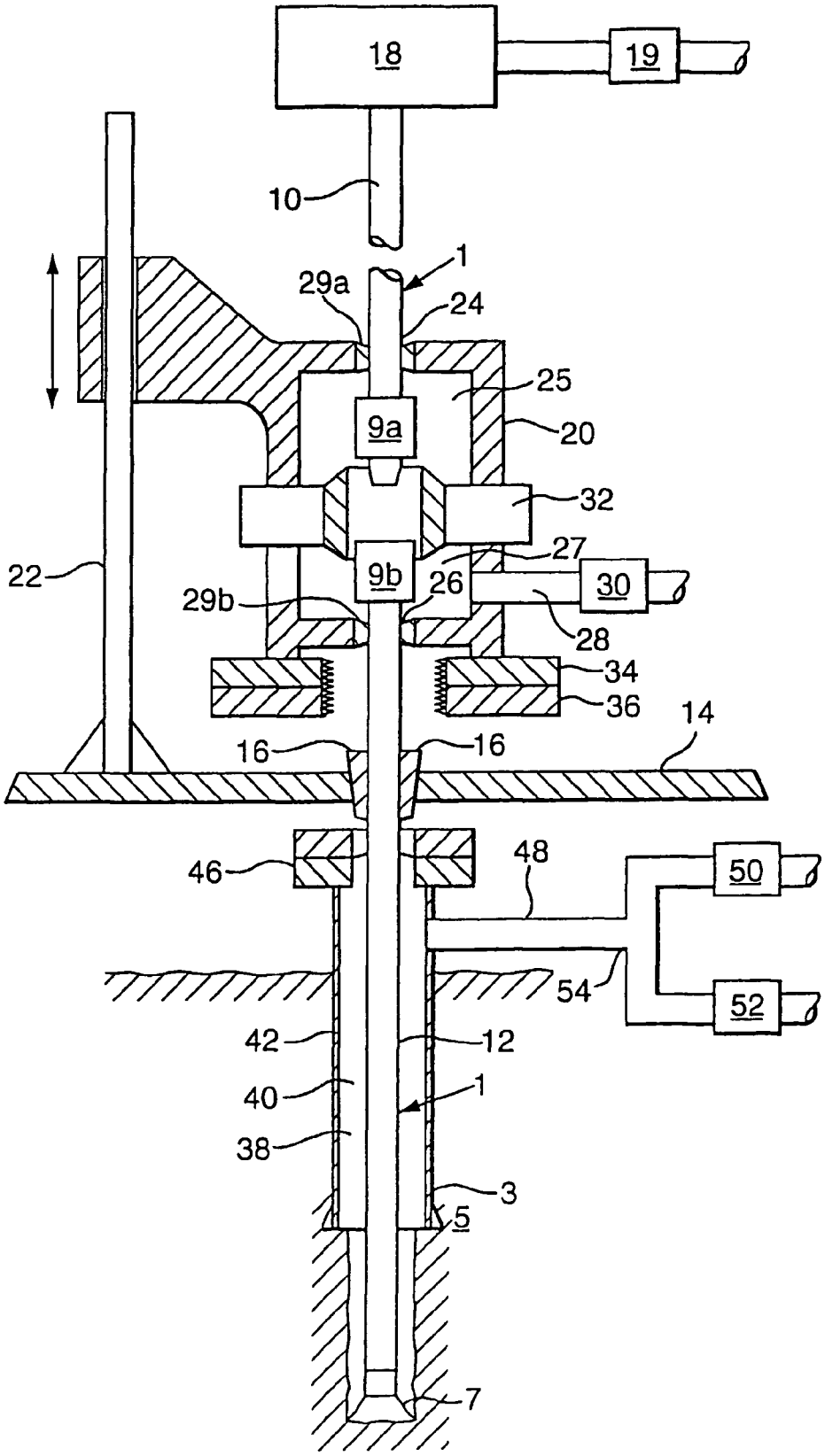
FIG. 1 schematically shows an embodiment of a drilling system.

In FIG. 1 is shown a drill string 1 extending into a borehole 3 formed in an earth formation 5 and provided with a drill bit 7 and a bottom hole assembly (BHA, not shown). The drill string 1 is made up of a plurality of drill string joints, whereby each pair of adjacent joints is interconnected by a releasable connector. For the purpose of clarity only one of the uppermost connectors 9*a*, 9*b*, which connects the uppermost joint to the remainder of the drill string 1, is shown (in disconnected mode). In the description hereinafter, the upper drill string joint is referred to as the upper drill string section 10 and the remainder of the drill string 1 is referred to as the lower drill string section 12. The lower drill section 12 is supported at rig floor 14 of a drilling rig (not shown) by power slips 16. The upper drill string section 10 is supported by a top drive 18 which is capable of supporting the entire drill string 1 and which is provided with a drive system (not shown) for rotating the drill string 1 during drilling. A primary pump 19 is in fluid communication with the upper drill string section to pump drilling fluid through the drill string 1 when the connector 9*a*, 9*b* is in connected mode.

A fluid chamber 20 is supported by a support column 22 provided at rig floor 14 in a manner allowing the fluid chamber 20 to move up or down along the column 22, and means (not shown) are provided to control such movement. The upper drill string section 10 extends into the fluid chamber 20 through an upper opening 24 of the fluid chamber 20 so that the open lower end of the upper drill string section 10 is located in an upper portion 25 of the chamber 20. The lower drill string section 12 extends into the fluid chamber 20 through a lower opening 26 of the fluid chamber 20 so that the open upper end of the lower drill string section 12 is located in a lower portion 27 of the chamber 20. Both upper opening 24 and de lower opening 26 are of a sufficiently large diameter to allow passage of the drill string connectors (which generally are of slightly larger diameter than the drill string sections) therethrough. Furthermore, the upper and lower openings 24, 26 are provided with seals 29*a*, 29*b* which are controllable so as to be moved radially inward and thereby to seal against the respective upper and lower drill string sections 10,12. The lower portion 27 of chamber 20 is provided with a fluid inlet 28 in fluid communication with a secondary pump 30 to pump drilling fluid through the lower drill string section 12 when the connector 9*a*, 9*b* is in disconnected mode.

The upper portion 25 and the lower portion 27 of the fluid chamber 20 are selectively sealed from each other by a partitioning means in the form of a valve 32. A control device (not shown) is provided to open or close the valve 32, whereby in its open position the valve 32 allows passage of drill string 1 through the valve 32. Furthermore, in the open position of the valve 32, the upper portion 25 and the lower portion 27 of the fluid chamber 20 are in fluid communication with each other. A pair of power tongues 34,36 connecting and disconnecting the connector 9*a*,9*b* is attached to the fluid chamber 20 at the lower side thereof.

An annular space 38 is defined between the lower drill string section 12 on one hand and the borehole wall and a wellbore casing 42 on the other hand, which annular space is filled with a body of drilling fluid 40. The annular space 38 is at its upper end sealed by a rotating blowout preventor (BOP) 46 which allows rotation and vertical movement of the drill string 1. A drilling fluid discharge conduit 48 is provided at the upper end of the annular space 38, which discharge conduit 48 debouches into a drilling fluid reservoir (not shown) via discharge means 50, which discharge means shall be elucidated hereinafter referring to FIGS. 2 and 3. A tertiary pump 52 is arranged in parallel with the discharge means 50, which pump 52 is in fluid communication with the discharge conduit 48 at a branch connection 54 located between the discharge means 50 and the rotating BOP 46. The pump 52 is operable so as to pump drilling fluid from a drilling fluid reservoir (not shown) into the annular space 38. The lower part of the drill string 1 is provided with means for controlling the flow of drilling fluid from the body of drilling fluid 40 into the drill string 1 in the form of a non-return valve (not shown) which prevents such return flow.

During normal operation the drill string 1 is rotated by the top drive 18 to further drill the borehole 3 whereby the connector 9*a*,9*b* is in connected mode. A stream of drilling fluid is pumped by primary pump 19 via the drill string 1 and the drill bit 7 into the annular space 38 where drill cuttings are entrained into the stream. The stream then flows in upward direction through the annular space 38 and via the discharge conduit 48 and the discharge means 50 into the drilling fluid reservoir (not shown). The fluid pressure in the annular space 38 is controlled by controlling the pump rate of pump 19 and/or by controlling the discharge means 50 and/or the tertiary pump 52.

When it is desired to remove the drill string from the borehole 3, the individual drill strings joints are to be disconnected and removed from the drill string 1 in sequential order. This is done by disconnecting and removing the uppermost joint, moving the drill string 1 upwardly to a position wherein the joint which is now the. uppermost joint can be removed, etc. To remove the uppermost joint (i.e. drill string section 10) the following procedure is followed. Rotation of the drill string 1 by the top drive 18 is stopped while drilling fluid is continuously circulated through the drill string by operation of primary pump 19. The fluid chamber 20 is moved along support column 22 to a position where the power tongues 34,36 are located at the level of the connector 9*a*,9*b*, whereupon the tongues 34,36 are operated so as to break out and partly unscrew the connector 9*a*,9*b*. The connector 9*a*,9*b* is unscrewed by the slips only to the extent that further unscrewing can be done by the top drive 18. The fluid chamber 20 is then moved along support column 22 so as to position connector 9*a*,9*b* inside the lower fluid chamber portion 27, and the seals 29*a*,29*b* are moved radially inward so as to seal against the respective upper and lower drill string sections 10,12. The secondary pump 30 is operated to pressurise fluid camber 20. The top drive is then rotated in counter clockwise direction thereby further unscrewing the connector 9*a*,9*b*. Once the connector 9*a*,9*b* becomes disconnected the upper drill string section 10 is raised a short distance so as to position the upper connector half 9*a* in the upper portion 25 of the fluid chamber 20. The valve 32 is closed so as to seal the upper fluid chamber portion 25 from the lower fluid chamber portion 27. Simultaneously with closing the valve 32 the primary pump 19 is stopped and the secondary pump 30 is operated to pump drilling fluid through the fluid inlet 28 into the lower fluid chamber portion 27 and from there through lower drill string section 12 into the annular space 38. The seal 29*a* is retracted to remove the upper drill string section, and the drill string joint which has now become the uppermost joint is connected to the top drive 18. The procedure described heretofore is repeated in order to remove the now uppermost drill string joint. By the continued circulation of drilling fluid through the borehole 3 it is achieved that undesired settling of particles (e.g. drill cuttings) in the borehole occurs, and that the fluid pressure in the borehole can be controlled by controlling the pump rate of pump 30 and/or controlling the discharge means 50.

Instead of using the secondary pump 30 to pump drilling fluid through the lower drill string section 12 when the connector 9*a*,9*b* is disconnected, the primary pump 19 can be used for this purpose in which case the primary pump 19 is connected to the fluid inlet 28 by suitable conduit means.

The above procedure relies on the use of the fluid chamber 20 to control the fluid pressure in the borehole by continued fluid circulation through the drill string 1 when the upper drill string section 10 is disconnected. In case it is impractical or impossible to use the fluid chamber an alternative procedure can be applied to connect or disconnect the upper drill string section 10 to or from the drill string 1. In the alternative procedure, which can be applied in the absence of the fluid chamber, the tertiary pump 52 is operated so as to pump drilling fluid through the circuit formed by the pump 52, the branch connection 54, and the discharge means 50. By controlling the pump rate of pump 52 and/or by controlling the discharge means 50 the fluid pressure in the annular space 38 can be controlled. The non-return valve in the drill string 1 prevents flow of drilling fluid from the annular space 38 into the drill string 1. The alternative procedure can be used, for example, in case drill string stabilisers prevent passage of the drill string through the fluid chamber.

An advantage of continued fluid circulation through the drill string 1 using the fluid chamber 20 when the upper drill string joint are disconnected, is that the drilling fluid in the open part of the borehole 3 keeps flowing so that undesired settling of particles in the borehole is prevented. However once the drill string has been raised to a level whereby the drill bit 7 is located within the casing 42, the drilling fluid which is pumped through the drill string 1 returns from the bit 7 through the annular space 38 to surface thereby leaving the drilling fluid in the open part of the borehole 3 stationary. It is therefore preferred that, once the drill bit 7 is within the casing 42, pumping of drilling fluid by secondary pump 30 is stopped and pumping by tertiary pump 52 is commenced to control the fluid pressure in the borehole. This procedure has the advantage that the fluid chamber 20 then is no longer required and can be removed from the drill string.

Figure 2:
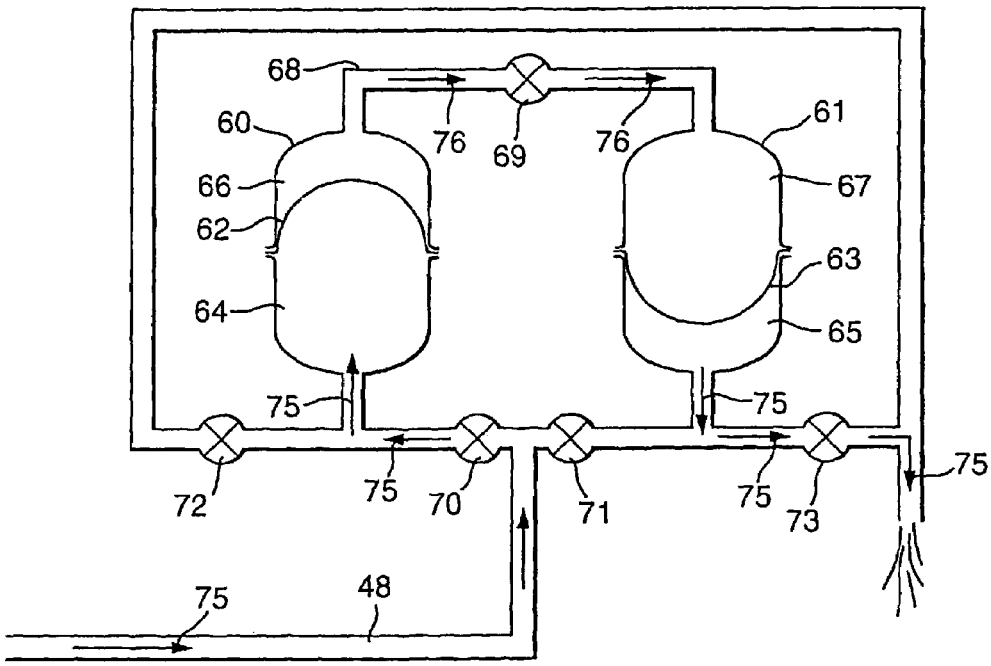
FIGS. 2 and 3 schematically show the drilling fluid discharge means.
Figure 3:
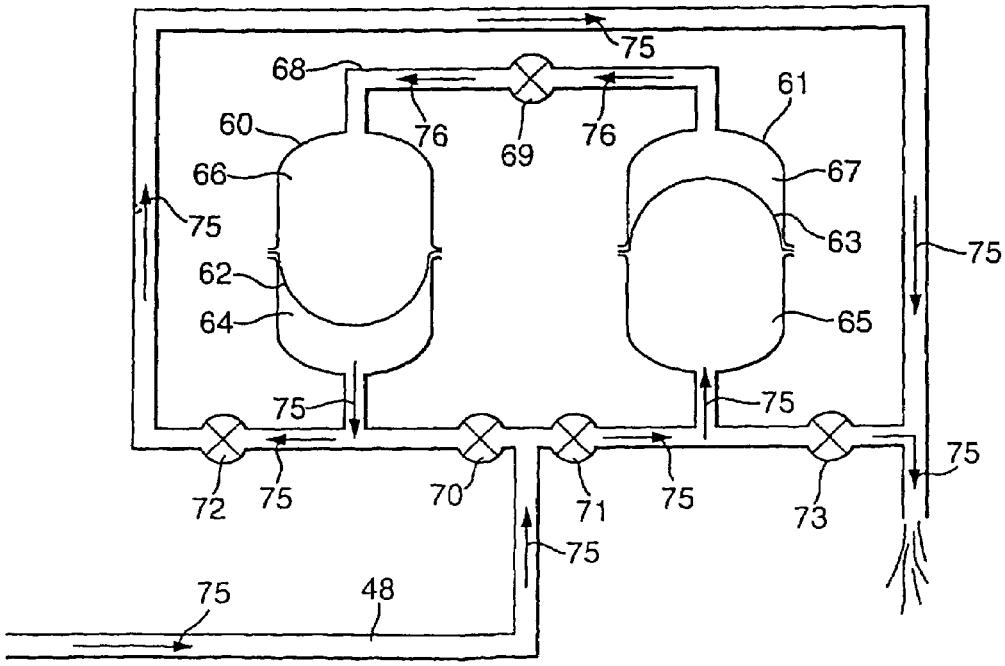

FIGS. 2 and 3 show the discharge means 50 in more detail. The flow of drilling fluid to be discharged is supplied to the discharge means by discharge conduit 48.

The discharge means comprise two pressure chambers 60,61. Each pressure chamber is provided with a membrane 62,63 made out of flexible material, such as rubber. The membrane 62,63 divides each pressure chamber 60,61 in two compartments, a drilling fluid compartment 64,65 and an expel fluid compartment 66,67. Both expel fluid compartments 66,67 are interconnected by an expel fluid conduit 68 passing a control valve 69, which control valve 69 is a choke valve for controlling the flow of expel fluid through conduit 68 by throttling that flow.

The drilling fluid compartment 64,65 of each pressure chamber 60,61 is provided with inlet valve means (70,71) to direct the drilling fluid to be discharged to the drilling fluid compartment 64 or 65 respectively, and is provided with outlet valve means (72,73) to remove drilling fluid from the drilling fluid compartment 64 or 65 respectively.

FIG. 2 shows a first mode of the discharge means and FIG. 3 shows a second mode.

In the first mode, as shown in FIG. 2, inlet valve 70 is open and inlet valve 71 is closed. Furthermore outlet valve 72 is closed and outlet valve 73 is open. The flow of drilling fluid is indicated with arrows 75. From conduit 48 the drilling fluid flows to drilling fluid compartment 64, whereby the membrane 62 is moved upwardly. Therefore expel fluid is expelled from compartment 66 through conduit 68 to expel fluid compartment 67, thereby passing choke valve 69. The flow of expel fluid is indicated with arrows 76. The inflow of expel fluid into compartment 67 moves the membrane 63 downward, expelling the drilling fluid from compartment 65, which drilling fluid can be further transported, for example to a filtering system (not shown).

The flow of drilling fluid to compartment 64 is controlled by controlling choke valve 69 up to the moment that drilling fluid compartment 64 is completely filled with drilling fluid. At that moment the discharge means are shifted to the second mode as shown in FIG. 3.

In the second mode, as shown in FIG. 3, inlet valve 70 is closed and inlet valve 71 is open. Furthermore outlet valve 72 is open and outlet valve 73 is closed. The flow of drilling fluid is indicated with arrows 75. From conduit 48 the drilling fluid flows to drilling fluid compartment 65, whereby the membrane 63 is moved upwardly. Therefore expel fluid is expelled from compartment 67 through conduit 68 to expel fluid compartment 67, thereby passing choke valve 69. The flow of expel fluid is indicated with arrows 76. The inflow of expel fluid into compartment 66 moves the membrane 62 downward, expelling the drilling fluid from compartment 64, which drilling fluid can be further transported, for example to a filtering system (not shown).

During operation of the discharge means the first and the second mode will alternate with each other, whereby the choke valve 69 may be maintained in the same position to achieve a predetermined resistance in expel conduit 68 in both modes. That will result in a constant resistance for the drilling fluid passing the discharge means. By changing the position of the choke valve 69 that resistance will be changed.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

The invention claimed is:

1. A drilling system for drilling a borehole into an earth formation, the drilling system comprising pump means for pumping drilling fluid into the borehole and discharge means for discharging drilling fluid from the borehole, wherein the discharge means comprises two or more pressure chambers arranged to be alternately filled with the drilling fluid from the borehole for temporarily accommodating drilling fluid being discharged from the borehole, and control means for controlling the fluid inflow into each pressure chamber, wherein the pressure chambers contain an expel fluid which is arranged to expel from a first one of the pressure chambers by the inflow of drilling fluid in that pressure chamber, into another of the pressure chambers, and wherein the control means is arranged to control the outflow of expel fluid from the first pressure chamber.

2. The drilling system of claim 1, wherein said control means is arranged to control the fluid pressure in the first pressure chamber.

3. The drilling system of claim 1, wherein the control means comprises a controllable throttle opening.

4. The drilling system of claim 1, wherein the control means comprises a throttle opening.

5. The drilling system of claim 1, wherein the first and the other said pressure chambers are interconnected by an expel fluid conduit for transporting the expel fluid between the pressure chambers.

6. The drilling system of claim 5, wherein the control means comprises a control valve in the expel fluid conduit.

7. The drilling system of claim 6, wherein the control valve is a choke valve for controlling the resistance in the expel fluid conduit.

8. The drilling system of claim 5, wherein each pressure chamber is provided with first and second compartments separated by a movable wall, whereby one of the compartments is filled with drilling fluid and the other compartment contains said expel fluid.

9. The drilling system of claim 8, wherein said movable wall includes a flexible membrane.

10. The drilling system of claim 8, wherein the compartments for expel fluid are interconnected by the expel fluid conduit for transporting the expel fluid between said compartments, and wherein said compartments together with the expel fluid conduit and the control means form a closed system.

11. The drilling system of claim 8, wherein the system further comprises inlet valve means to direct the drilling fluid to be discharged alternately to one of said drilling fluid compartments and with outlet valve means to remove drilling fluid from the other drilling fluid compartment.

12. A method of drilling a borehole into an earth formation, comprising pumping a drilling fluid into the borehole and discharging the drilling fluid from the borehole and transporting the discharged drilling fluid to two or more pressure chambers, alternately filling the two or more pressure chambers with the drilling fluid from the borehole whereby an expel fluid is expelled from a first one of the pressure chambers by the inflow of drilling fluid in that pressure chamber, into another of the two or more pressure chambers, and controlling the inflow of drilling fluid into the first pressure chamber by controlling the outflow of expel fluid which is expelled from the first pressure chamber by the inflow of drilling fluid in that pressure chamber.

13. The method of claim 12, whereby said inflow of drilling fluid is controlled by controlling the fluid pressure in the first pressure chamber.

14. The method of claim 12, further comprising transporting the expel fluid from first pressure chamber to the other pressure chamber and controlling the transporting by a control valve.

15. The method of claim 12, further comprising controlling the inflow of drilling fluid into each of the pressure chambers.

16. The method of claim 12, whereby each pressure chamber is provided with a membrane to form a drilling fluid compartment and an expel fluid compartment, both having a variable content, the expel fluid compartments being interconnected by the expel fluid conduit, the method further comprising alternately directing the drilling fluid to be discharged to one of said drilling fluid compartments, while drilling fluid from the other drilling fluid compartment is removed.

17. The method of claim 12, comprising controlling the discharge of the drilling fluid from the borehole by throttling the expel fluid.

18. The method of claim 12, further comprising directing the expel fluid which is expelled from the first pressure chamber through a throttle opening.

19. The method of claim 18, comprising controlling the throttle opening, thereby controlling the inflow of the drilling fluid into the first pressure chamber.

* * * * *